United States Patent [19]

Pastva

[11] Patent Number: 4,483,557

[45] Date of Patent: Nov. 20, 1984

[54] DOOR CLOSURE MECHANISM HAVING ADJUSTABLE KEEPERS

[75] Inventor: John V. Pastva, Parma Heights, Ohio

[73] Assignee: The Eastern Company, Cleveland, Ohio

[21] Appl. No.: 419,227

[22] Filed: Sep. 17, 1982

[51] Int. Cl.[3] ..... E05C 9/08

[52] U.S. Cl. ..... 292/218; 292/341.18

[58] Field of Search ..... 292/218, 341.18, 341.19

[56] References Cited

U.S. PATENT DOCUMENTS

| | | | |
|---|---|---|---|
| 1,688,626 | 10/1928 | Kissinger et al. | 292/341.18 |
| 1,919,328 | 7/1933 | Hansen | 292/218 |
| 2,309,049 | 1/1943 | Curtiss, Jr. et al. | 292/341.18 X |
| 2,861,830 | 11/1958 | Bennett | 292/218 X |
| 2,941,834 | 6/1960 | Appleton et al. | 292/341.19 |

*Primary Examiner*—Richard E. Moore

*Attorney, Agent, or Firm*—Watts, Hoffmann, Fisher & Heinke

[57] ABSTRACT

A door closure mechanism is provided with a plurality of adjustable keeper members. Each adjustable keeper includes a base secured to a member adjacent the free end of the door, side walls and a top wall. A latch engagement member is slidably secured to the top wall and includes an inclined latch engagement surface. The latch engagement member can be positioned to have an associated latching member of the door closure mechanism engage the latch engagement member at various positions along the latch engagement surface permitting the spacing between the door and the frame or an adjacent door to be adjustable in a direction substantially perpendicular to the door when in a fully closed position.

5 Claims, 5 Drawing Figures

DOOR CLOSURE MECHANISM HAVING ADJUSTABLE KEEPERS

DESCRIPTION

1. Technical Field

This invention relates to a door closure mechanism of the cam and keeper type and is particularly directed to a door closure mechanism having an adjustable keeper that can be used on trucks and the like.

2. Background Art

Load carrying compartments such as trucks typically utilize pivoted doors at one end wall to facilitate loading and unloading. Door closure mechanisms are used with such doors to retain the doors closed. These mechanisms typically include a locking rod rotatably attached on the exterior face of each door and extending parallel to the pivot axis along or adjacent to the door's free end, a handle fixed to the rod to facilitate rotation, latching cams spaced along and fixed to the rod, and keepers on the adjacent door and truck frame to receive the latching cams. The handle is rotated in one direction to permit initial engagement of the latching cams in the keepers. Rotation of the handle in another direction, typically toward the door, causes the door to be urged toward the frame. The door closure mechanism is in the fully engaged position when the handle is rotated and lies flush against the door. An elastomeric frost seal, of the type used on a refrigeration vehicle, forms an air tight closure between the doors and the frame. When the truck has two adjacent pivot doors, a frost seal is also fixed to the free end of one of the doors and forms an air tight seal between the doors. Over a matter of time, an elastomeric seal loses its resilient properties and/or takes a set which permits air to leak between the two doors and/or between the doors and the frame. Air leaks also result from warping of the doors and/or the frame. It is well appreciated in the art that such air leaks are extremely undesirable particularly in refrigeration vehicles.

One device which addresses this problem is a clamptite door lock assembly having an adjustable takeup handle such as Model No. 15-5628 manufactured by the Eberhard Manufacturing Company, the assignee of the present application. An adjustment is provided between the handle and the locking rod for adjusting the relative rotational position between the rod and the handle to vary the spacing between a door and the frame. No matter how many latching cam and keeper combinations are spaced along the rod, only one adjustment is made that varies the amount of rod rotation necessary to have the door closure mechanism in the fully engaged position. This type of an adjustable door mechanism however does not accommodate variations in the door-to-door and the door-to-frame spacing that can exist along the sealing surfaces.

DISCLOSURE OF THE INVENTION

In accordance with this invention, there is provided a new and improved door closure mechanism especially adapted for use on trucks and the like of the type that have a frost seal between a door and the frame and between adjacent doors. The new and improved door closure mechanism is designed to provide a plurality of adjustments to vary the spacing between the doors and between the doors and the frame to prevent air leaks therebetween. The spacing adjustment is made in a direction substantially perpendicular to the doors when they are in a fully closed position.

An adjustable keeper member of the present invention for use with a door closure mechanism and the like of the type having a locking rod, latch cams fixed to the rod and a handle for rotating the rod comprises a base and a movable latch engagement member having an engagement surface spaced from the base. The latch cam engages the engagement surface at a location spaced a distance from the base. The keeper is constructed to facilitate adjusting the distance between the base and the location at which the latch cam engages the engagement surface.

The present invention is especially useful for adjusting the spacing between a pivoted door and a member such as a truck frame or a second door in a direction substantially perpendicular to the door when in its fully closed position. For example, the present invention is advantageously used on doors of trucks and complements the door latches by providing individual adjustments to the door closure mechanism to establish a desired spaced relationship between the door and the truck frame or another door in a substantially perpendicular direction to the door when the door is in the fully closed position.

Basically, in the preferred embodiment of the invention, a door closure mechanism of the type that latches a pivoted door or doors in a closed position is provided. A pivoted door has a pivot axis and a free end. A door closure mechanism for such a door comprises keeper members adapted to be secured to a member adjacent the free end of such door. A shaft is adapted to be rotatably secured to the door with its longitudinal axis spaced from and parallel to the pivot axis of the door. Latch cams are secured to the shaft with each having a portion extending transversely therefrom. The extending portions cooperate with respective keeper members for securing the associated door in a closed position. A handle on the shaft facilitates rotation to move the latch cams into and out of a latched position Each keeper member of the present invention comprises a base fixedly secured to a member near the free end of the door, parallel spaced side walls projecting approximately perpendicularly from the base, and a top wall spaced from and approximately parallel with the base. The top wall has a slot that extends perpendicular to the pivot axis of the associated door. A fastener extends through the slot toward the base and supports a latch engagement member, surrounded by the walls and base, for sliding adjustment. The latch engagement member has an inclined engagement surface facing toward the base and the keeper. When the shaft is rotated to a latched position, an associated latching cam contacts the engagement surface at a location spaced a distance from the base that depends on the position of the latch engagement member along the slot. A door is urged in a closed position by its associated door closure mechanism. The space between the door and the member or members about the door periphery, which accommodate a sealing gasket, is dependent upon the distance between the base and the portion of the inclined engagement surface that the latching cam contacts. That distance is a function of the location or position of the latch engagement member along the slot in the top wall.

One advantage of the present invention is that the spacing between the door and the door frame and/or another door can be separately and easily adjusted at several locations near the free end of the door, where cam and keepers are positioned. Having such adjustments is particularly advantageous on refrigeration units, where frost seals are used.

The above and other features and advantages of the invention will become better understood from the detailed description of the preferred embodiment described with reference to the accompanying drawings.

BEST MODE FOR CARRYING OUT THE INVENTION

Figure 1:
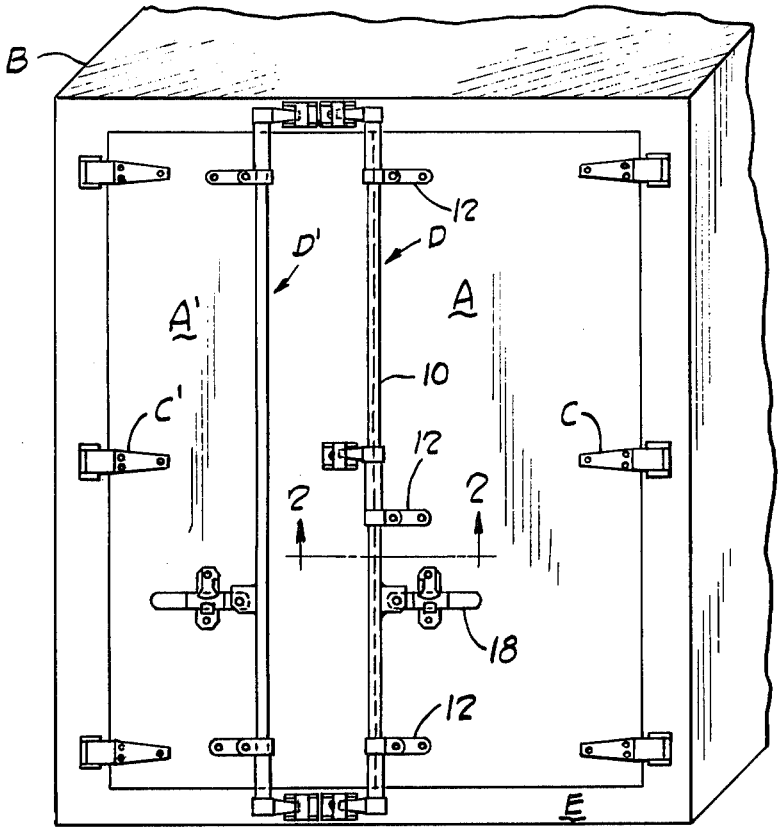
FIG. 1 is a partial isometric view of the back end of a truck trailer showing a preferred embodiment of the door closure mechanism made in accordance with the present invention.
Figure 2:
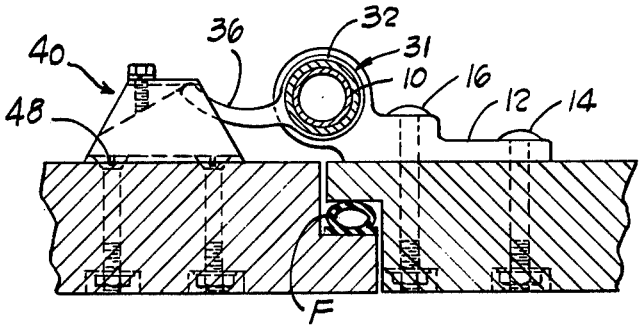
FIG. 2 is a partial sectional view taken along section line 2—2 of FIG. 1.
Figure 3:
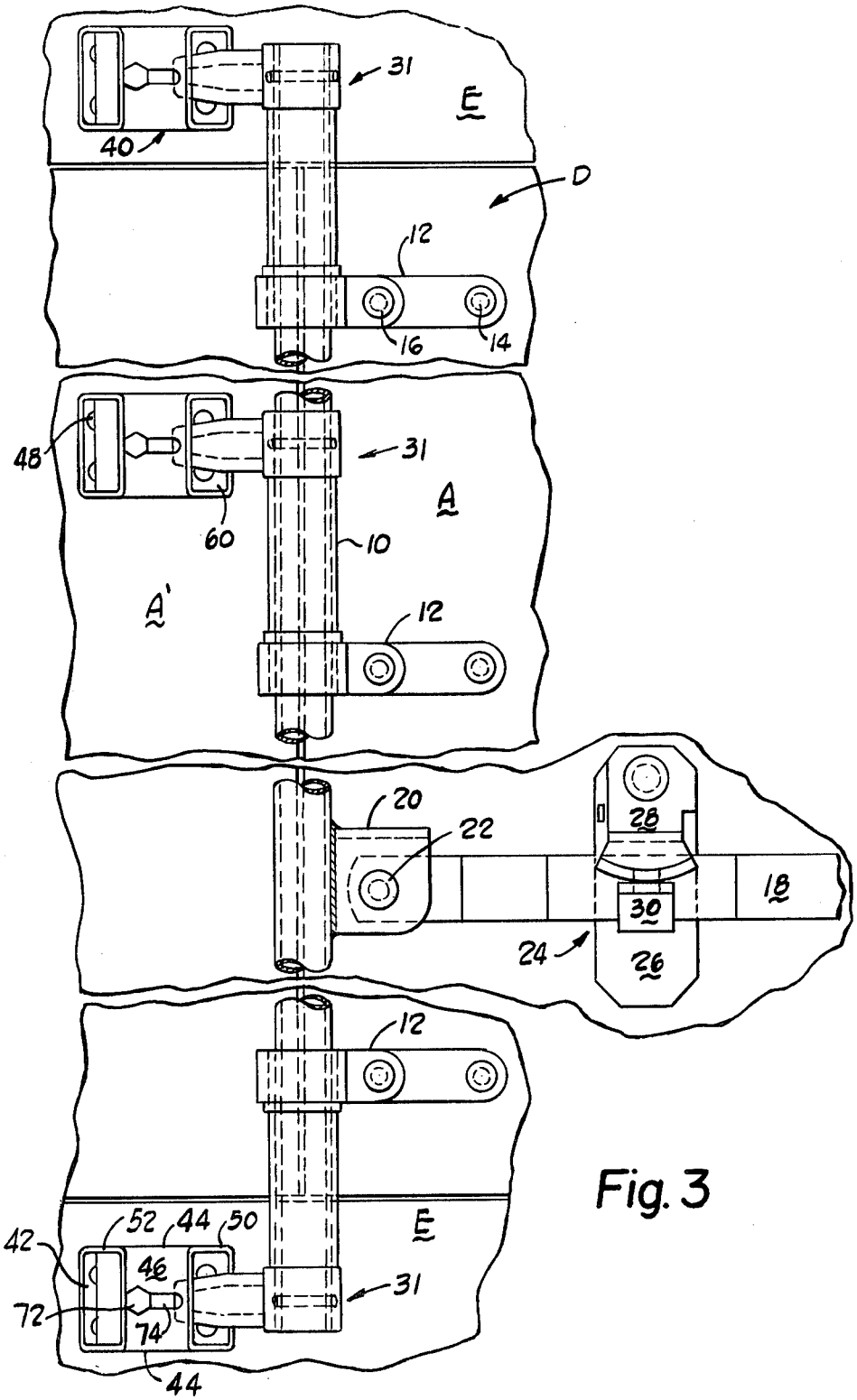
FIG. 3 is a front elevation showing one of the door closure mechanisms of FIG. 1 on a larger scale with portions broken away.

The present invention, as embodied in a truck body, is illustrated in FIG. 1. Pivoted rear doors A, A′ are secured to a truck trailer B by hinges C, C′ respectively along a vertical edge of the doors. Door closure mechanisms D, D′ are in part secured to the door frame E and in part to the adjacent doors A, A′ along or adjacent to the free vertical edges thereof. The doors, door frame, and hinge constructions are conventional to trucks. The door hinges C, C′ establish vertical pivot axes spaced outwardly from the frame E and the plane of the doors, the outside of the doors typically being flush with the door frame. A frost seal F, shown in FIG. 2, is provided between the doors A, A′ to form a seal therebetween. Other frost seals, not shown, are used between each door and the frame E to seal the associated door and the frame and prevent air leaks therebetween. The door closure mechanisms D, D′ respectively urge the doors A, A′ against the frame E and against each other with the frost seals being compressed therebetween. If the frost seals have taken a set or the frame E and/or the doors A, A′ are warped, air leaks can occur.

FIG. 1 shows two door closure mechanisms D, D′. For purposes of clarity, only one door closure mechanism D will be described in detail it being understood that the other door closure mechanism is similar in structure.

A door closure mechanism D made in accordance with the present invention is best shown in FIGS. 2 through 5. The door closure mechanism D comprises a shaft or locking rod 10 having a longitudinal axis parallel with the pivot axis of the door A defined by the hinges C. Intermediate bearing brackets 12 rotatably secure the locking rod 10 to the door A near its free end by means of bolts 14, 16.

A handle 18 is operatively secured to the locking rod 10 to facilitate rotation of the locking rod about its longitudinal axis. A handle clip 20 is fixed to the locking rod 10 and projects toward the pivoted end of the door A when the door is latched. The handle 18 is secured to the handle clip 20 by means of a pivot pin 22. A handle retainer 24 is fixed to the door A and is provided to retain the handle 18 in a position substantially flush against the door A. The handle retainer 24 comprises a retainer back plate 26, a pivoted handle retainer clip 28 and a handle receiving portion 30. The operation of the handle assembly 24 and handle 18 are well known in the art and will not be described in detail herein. When the handle 18 is secured in the handle receiving portion 30, the door closure mechanism D is in the fully engaged position.

A plurality of latching members 31 are secured to the locking rod 10 at spaced apart locations along the longitudinal axis of the locking rod. For the purpose of clarity in explanation, only one latching member will be described, it being understood that all other latching members are similar in structure. A latching member 31 comprises a cylindrical body member 32 fixed to the locking rod 10 by means of a pin 34. Integral with the main body member 32 is a latching cam portion 36 which extends transversely of the locking rod. Rotation of the locking rod 10 by means of the handle 18 causes the latching cam portion 36 to rotate about the longitudinal axis of the locking rod 10.

The latching member 31 has an associated keeper member 40 adapted to receive the latching cam portion 36. It can be seen from FIG. 1 that two of the keeper members 40 are secured to frame E and one keeper member is secured to the adjacent door A′. The positioning of latching members 31 and their associated keeper members 40 can vary from that shown. For clarity, only one keeper member will be described, it being understood that all other keeper members are similar in structure. A keeper member 40 is of a tubular configuration with inclined ends and comprises a base 42, parallel, spaced apart side support walls 44 and a top wall 46. The side support walls are fixed to and extend perpendicularly from the base 42. The top wall 46 is supported by the walls 44 and is parallel with and spaced from the base 42. The keeper member 40 is secured to a member by means of fasteners 48.

The support walls 44 have inclined end surfaces 50, 52. The base, support walls and top wall form an opening 60 that receives the latching cam portion 36. The inclined end surfaces 50, 52 facilitate installation of the keeper 40 to a member by providing tool access to the fasteners 48. The top wall 46 is shorter than the spacing between the fasteners 48 to aid in the mounting operation.

The door closure mechanism for door A is a three cam and keeper device. The two keepers associated with the cams at the end of the locking rod are mounted on the frame E. The middle keeper associated with the middle cam is mounted on door A′. The door closure mechanism for door A′ is a two cam and keeper device with both keepers being mounted on the frame E.

Figure 4:
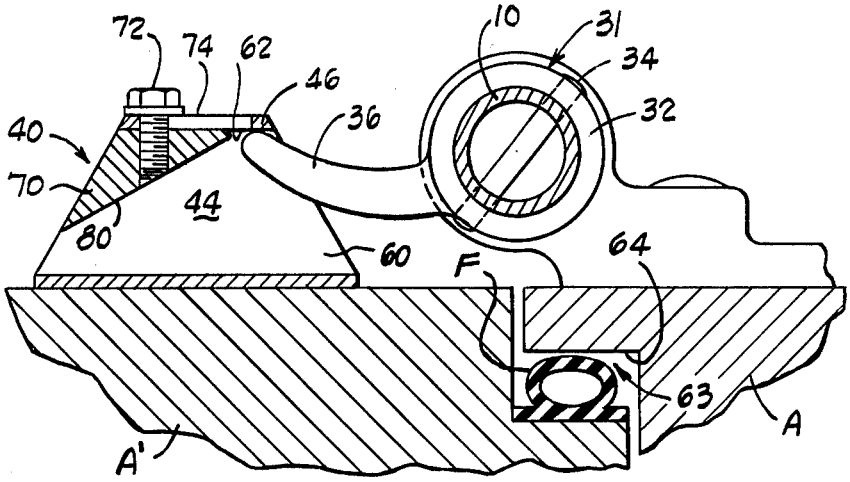
FIG. 4 is a view similar to that of FIG. 2 on a larger scale with the latch cam not engaging the latch engagement member.

To describe the latching operation of door A, it is assumed that door A′ is already fully closed and latched. To latch the door A in a closed position without any adjustment of the keeper members, the handle 18 is rotated away from the door A. The door is pushed closed by the operator with each latching cam portion 36 being positioned to enter the opening 60 of its associated keeper 40. As the handle 18 is rotated toward the door A, the latching cam 36 engages an inner surface 62 of the top plate 46. The handle 18 is then rotated further toward the door A which in turn rotates the locking rod 10 and each latching cam portion 36. The lever action of the handle 18 in combination with each latching cam portion 36 and each keeper 40 urges the door A to a closed position. The door closure mechanism is in a fully engaged position when the handle 18 is substantially flush against door A and is placed in the handle receiving portion 30 of the handle assembly 24. FIG. 4 depicts a situation in which a part of the door A and the frost seal F between doors A, A' are not in contact. Warping of the doors A, A' and/or the frame E, or a permanent set in the frost seal F, can cause a gap 63 to occur, which in turn allows air to leak between the doors A, A'.

A latch engagement member 70 is secured to the surface 62 of the top wall 46 of each keeper member 40 by means of a bolt 72 extending through an elongated slot 74 in the top wall 46 and received in a hole 76 and in a self-locking elastic stop nut 77 captive within a hex-shaped counter bore 79 in the latch engagement member 70. The elongated slot 74 has a longitudinal extent perpendicular to the longitudinal axis of the associated locking rod 10 and to the pivot axis of the associated door. The latch engagement member 70 has a latch engagement surface 80 that is inclined with respect to the base 42.

When a gap 63 occurs between the door and the frost seal, at least one keeper member close to such gap is adjusted to change the spacing between the doors and/or the doors and frame to close the gap. A latch engagement member 70 for a keeper member close to the gap 63 is positioned so that the latching cam portion 36 engages the engagement surface 80 when the door closure mechanism D is rotated into a fully latched position. The adjustment is made with the door closure mechanism D in the unlatched position.

Figure 5:
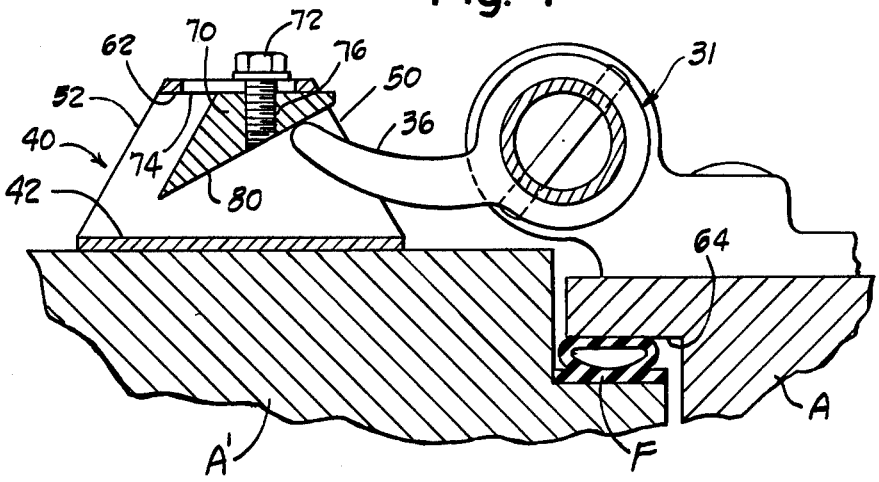
FIG. 5 is a view similar to that of FIG. 4 with the latch cam engaging the latch engagement member.

To accomplish the adjustment, the bolt 72 of a desired keeper member is loosened and the latch engagement member is slid toward the door opening. The bolt 72 is then tightened to secure the latch engagement member in position against the top plate 46. During the latching operation of the door closure mechanism D, the associated latching cam portion 36 for the adjusted keeper member engages the inclined engagement surface 80. The distance between the base 42 and the location along the engagement surface where the latching cam portion 36 comes in contact decreases as the latching engagement member is positioned closer toward the door opening. As the distance between the base 42 and the point of contact along the inclined engagement surface 80 changes, the relative displacement between the doors and/or the doors and the frame changes when the handle is in the fully engaged position. The change in spacing occurs in a direction substantially perpendicular to the door when the door is in the fully closed position. As can be seen in FIG. 5, the adjusted keeper in combination with the associated latching cam portion decreases the gap between doors A, A' and causes the seal F to be compressed. As those skilled in the art will appreciate, the spacing between the doors and the frame can be changed at different locations about the door periphery by adjusting the position of a latch engagement member 70 for the keeper at or near such location. If the door is warped only at the top, for example, only the keeper member closest to the top location would be adjusted. Thus, it will be seen that the door to door or the door to frame spacing is dependent upon the distance between the base 42 and the location on the engagement surface 80 that the latching cam portion 36 engages.

While a preferred form of the invention has been described, it will be apparent that the invention is not limited to the construction shown or for the uses referred to and it is my intention to cover all adaptations, modifications, and changes which come within the practice of those skilled in the art to which the invention relates and the scope of the appended claims.

I claim:

1. An adjustable keeper for use with a door closure mechanism or the like of the type having a locking rod, a latch member fixed to the rod and a handle for rotating the rod, said adjustable keeper member comprising:

a base having a mounting face;

a support member extending from said base;

a latch engagement member movably secured to said support member and having a latch engagement surface inclined with respect to said mounting face and positioned to be engaged by a latch member at a location along the inclined surface; and means for repositioning said latch engagement member at a location displaced from its secured position in a direction generally parallel to the base mounting face so a latch member will engage said latch engagement surface at a different location along the inclined surface in use.

2. An adjustable keeper member for use with a door closure mechanism or the like of the type having a locking rod, a latch member fixed to the rod and a handle for rotating the rod, said adjustable keeper member comprising:

a base having a mounting face;

a support wall fixed to said base and extending therefrom;

a top wall fixed to said support wall and spaced from said base, said top wall having an elongated opening;

a latch engagement member slidably secured to said top wall by fastening means extending through said opening in said top wall, said latch engagement member located between said top wall and said base and having a latch engagement surface inclined with respect to said mounting face and spaced from said base, said latch engagement surface positioned to be engaged by a latch member at a location along the inclined surface, the location of engagement being changeable by sliding the latch engagement member with respect to said top wall in a direction parallel to the base mounting face.

3. A door closure mechanism of a type that latches a pivoted door in a closed position, said door having a pivot axis and a free end, said mechanism comprising keeper members adapted to be secured to a member adjacent the free end of the door, a shaft adapted to be rotatably secured to the door with its longitudinal axis spaced from and parallel with the pivot axis of the door, latch members secured to said shaft each having a portion extending therefrom and transverse to said shaft, said extending portion cooperable with a keeper member for securing the door in a closed position, and a handle fixed to said shaft for rotating said shaft to move said latch members into and out of a latched position, said keeper members each having:

a base fixedly secured to said member adjacent the free end of the door;

at least one support wall fixed to said base and projecting from and approximately perpendicular to said base;

a top wall secured to said support wall and spaced from said base, said top wall having an elongated opening; and a latch engagement member secured to and adjustable along said top plate to different positions along a path parallel to the base by a fastening means extending through said elongated opening, said latch engagement member located between said top plate and said base, said latch engagement member having a latch engagement surface inclined with respect to said base;

whereby an associated latch member engages said engagement surface at a location determined by the position of said latch engagement member with respect to said base when said shaft is rotated to a latched position, said door is urged to the closed position by the latch members, and the tightness to which the door is closed is dependent upon the location of engagement member.

4. A door closure mechanism of a type that latches a pivoted door in a closed position, said door having a pivot axis and a free end, said mechanism comprising keeper members adapted to be secured to a member adjacent a free end of the door, a shaft adapted to be rotatably secured to the door with its longitudinal axis spaced from and parallel with a pivot axis of the door, latch members secured to said shaft each having a portion extending therefrom and transverse to said shaft, said extension portion cooperable with said keeper members for securing the door in a closed position, and a handle fixed to said shaft for rotating said shaft to move said latch members into and out of a latched position, said keeper members each having:

a base fixedly secured to said member adjacent the free end of the door;

support walls projecting from and approximately perpendicular to said base;

a top wall fixed to said support walls and spaced from and approximately parallel with said base, said top wall having an elongated opening with a longitudinal extent approximately perpendicular to said pivot axis when secured to a said member for use;

a fastening means extending through said elongated opening toward said base; and a latch engagement member slidably secured to and adjustable along said top wall to different positions along a path parallel to the base by said fastening means, said latch engagement member having a latch engagement surface inclined with respect to said base;

whereby an associated latch member engages said engagement surface at a location which depends on the position of the latch engagement member with respect to said base and the closed position of said door is dependent upon the position of the latch engagement member with repsect to said base.

5. The door closure mechanism of claim 4 wherein said support walls have inclined ends and said top wall is shorter than said base to facilitate securing of said base to said member adjacent the free end of the door.

* * * * *